US010047425B2

(12) United States Patent
Harrison et al.

(10) Patent No.: US 10,047,425 B2
(45) Date of Patent: Aug. 14, 2018

(54) ARTIFICIAL AGING PROCESS FOR HIGH STRENGTH ALUMINUM

(71) Applicant: Ford Global Technologies, LLC, Dearborn, MI (US)

(72) Inventors: Nia R. Harrison, Ann Arbor, MI (US); S. George Luckey, Jr., Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 207 days.

(21) Appl. No.: 14/055,476

(22) Filed: Oct. 16, 2013

(65) Prior Publication Data

US 2015/0101718 A1 Apr. 16, 2015

(51) Int. Cl.
*C22C 21/10* (2006.01)
*C22F 1/053* (2006.01)

(52) U.S. Cl.
CPC ..... *C22F 1/053* (2013.01); *C22C 21/10* (2013.01)

(58) Field of Classification Search
CPC ..... C22F 1/053; C22C 21/10
See application file for complete search history.

(56) References Cited

U.S. PATENT DOCUMENTS 3,791,880 A * 2/1974 Hunsicker ..... C22C 21/10 148/417
4,030,947 A 6/1977 Kemper
4,495,001 A 1/1985 Bennett et al.
5,178,695 A 1/1993 LaSalle et al.
2002/0121319 A1* 9/2002 Chakrabarti et al. ..... 148/694
2006/0000094 A1 1/2006 Garesche et al.

FOREIGN PATENT DOCUMENTS

CN 101701308 5/2010
CN 103233148 8/2013

OTHER PUBLICATIONS

Military Specification, "Heat Treatment of Aluminum Alloys", Document No. MIL-H-6088G, Apr. 1, 1991, 71 pages, U.S. Government Printing Office—1991.
Chinese Office Action dated May 17, 2017 corresponding to CN Application No. 201410550730.9.

* cited by examiner

*Primary Examiner* — Deborah Yee
(74) *Attorney, Agent, or Firm* — Brooks Kushman P.C.

(57) ABSTRACT

A method of age hardening a 7xxx series aluminum alloy is provided that includes heat treating the alloy at a first temperature for a first exposure time and heat treating the alloy at a second temperature that is higher than the first temperature for a second exposure time. The age hardening process may be used to form an alloy having a yield strength of at least 490 MPa and the total age hardening time may be 8 hours or less. In one example, the first heat treatment is performed at 100° C. to 150° C. for 0.2 to 3 hours and the second heat treatment is be performed at 150° C. to 185° C. for 0.5 to 5 hours.

15 Claims, 3 Drawing Sheets

ARTIFICIAL AGING PROCESS FOR HIGH STRENGTH ALUMINUM

TECHNICAL FIELD

This disclosure relates to an artificial aging process for aluminum alloys.

BACKGROUND

Automotive body panels have traditionally been made from mild steels. In an effort to decrease vehicle weight, aluminum alloy body panels have been increasing in popularity. The automotive and aerospace industries have focused primarily on the 5xxx and 6xxx series aluminum alloys, which are aluminum-magnesium and aluminum-magnesium-silicon alloys, respectively. The 5xxx and 6xxx series aluminum alloys may be shaped and processed by methods consistent with those of mild steel sheets. Aluminum-zinc alloys of the 7xxx series may achieve yield strengths similar to those of high strength steels, if they are age hardened. However, 7xxx series alloys may be received in a variety of tempers, some of which may be difficult to process and require further heat treatment before the age hardening process. For example, a 7xxx material received with a T6 temper may be difficult to draw or stretch at room temperature.

SUMMARY

In at least one embodiment, a method of age hardening a 7xxx series aluminum alloy is provided. The method may comprise heat treating the alloy at a first temperature for a first exposure time and heat treating the alloy at a second temperature that is higher than the first temperature for a second exposure time to form an alloy having a yield strength of at least 490 MPa. A sum of the first and second exposure times may be from 1 to 8 hours.

The first temperature may be from 100° C. to 150° C. in one embodiment, or from 105° C. to 135° C. in another embodiment. The second temperature may be from 155° C. to 185° C. in one embodiment, or from 160° C. to 180° C. in another embodiment. The first exposure time may be from 0.2 to 3 hours in one embodiment or from 1 to 2 hours in another embodiment. The second exposure time may be from 0.5 to 5 hours in one embodiment or from 1 to 4 hours in another embodiment. The sum of the first and second exposure times may be from 1.5 to 7 hours. The heat treatment at the second temperature may form an alloy having a yield strength of at least 500 MPa.

The alloy may be formed as a blank, part, or rack of parts and the 7xxx series aluminum alloy may be a 7075 aluminum alloy. Heat treating at the first temperature may be performed in a first heating apparatus and the heat treating at the second temperature may be performed in a second heating apparatus. The alloy may be transported from the first heating apparatus to the second heating apparatus by a conveyor. However, the heat treating at the first temperature and the heat treating at the second temperature may also be performed the same heating apparatus in some embodiments.

A method of age hardening a 7xxx series aluminum alloy may comprise a first heat treatment at 105° C. to 145° C. for 0.2 to 3 hours and a second heat treatment at 155° C. to 185° C. for 0.5 to 5 hours. The method may form an alloy having a yield strength of at least 490 MPa.

The first heat treatment may be at 105° C. to 135° C. and the second heat treatment may be at 160° C. to 180° C. The first heat treatment may be for 1 to 2 hours and the second heat treatment may be for 1 to 4 hours. The second heat treatment may form an alloy having a yield strength of at least 500 MPa.

DETAILED DESCRIPTION

Figure 1:
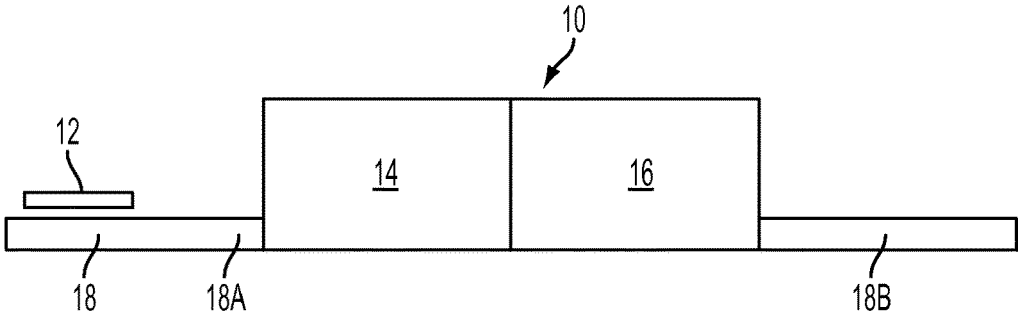
FIG. 1 is a schematic of a system for heat treating an aluminum alloy components.

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Aluminum alloys are generally identified by a four-digit number, wherein the first digit generally identifies the major alloying element. The major alloying element in 7xxx series aluminum is zinc while the major alloying element of 5xxx series is magnesium and for 6xxx series is magnesium and silicon. Additional numbers represented by the letter "x" in the series designation define the exact aluminum alloy. For example, a 7075 aluminum alloy may be used that has a composition of 5.1-6.1% zinc, 2.1-2.9% magnesium, 1.2-2.0% copper, and less than half a percent of silicon, iron, manganese, titanium, chromium, and other metals. Unlike the 5xxx and 6xxx series aluminum alloys, which may be processed similarly to mild steels, the 7xxx series requires an age hardening process (also known as precipitation hardening) in order to achieve a high yield strength (YS), for example a YS of over 400 MPa. For example, certain 5xxx and 6xxx alloys are suitable for high volume stamping, however, 7xxx alloys require a solutionizing treatment, a quench, and a subsequent age hardening process, which would distort a part originally stamped from a tempered 7xxx alloy.

In 7xxx series alloys the major alloying elements are added to introduce specific properties such as strength and toughness through precipitation hardening. The minor alloying elements indirectly affect properties as grain refiners/pinners. The major alloying elements in 7xxx series are Zn, Mg, and Cu which have solid solubility for solution heat treatment. The minor alloys elements have low solid solubility, and thus support grain refinement during solution heat treatment and quench.

Age hardening is preceded by a solution heat treatment (or solutionizing) and quench of the aluminum alloy material. A solution treatment generally includes heating the alloy to at least above its solvus temperature and maintaining it at the elevated temperature until the alloy forms a homogeneous solid solution or a single solid phase and a liquid phase. The temperature at which the alloy is held during solutionizing is known as the solution temperature. For example, the solution temperature for a 7xxx series aluminum alloy may be approximately 460° C. to 490° C. and the solution treatment may last from about 5 to 45 minutes. However, any suitable solution temperature and/or time may be used for a given aluminum alloy. The solution temperature may be the temperature at which a substance is readily miscible. Miscibility is the property of materials to mix in all proportions, forming a homogeneous solution. Miscibility may be possible in all phases; solid, liquid and gas.

Following the solution treatment, a quenching step is performed in which the alloy is rapidly cooled to below the solvus temperature to form a supersaturated solid solution. Due to the rapid cooling, the atoms in the alloy do not have time to diffuse long enough distances to form two or more phases in the alloy. The alloy is therefore in a non-equilibrium state. Quenching may be done by immersing the alloy in a quenching medium, such as water or oil, or otherwise applying the quenching medium (e.g., spraying). Quenching may also be accomplished by bringing the alloy into contact with a cooled surface, for example, a water-cooled plate or die. The quench rate may be any suitable rate to form a supersaturated solution in the quenched alloy. The quench rate may be determined in a certain temperature range, for example from 400° C. to 290° C. In at least one embodiment, the quench rate is at least 100° C./sec. The quench may be performed until the alloy is at a cool enough temperature that the alloy stays in a supersaturated state (e.g., diffusion is significantly slowed), such as about 290° C. The alloy may then be air cooled or otherwise cooled at a rate slower than the quench rate until a desired temperature is reached. Alternatively, the quench may be performed to a lower temperature, such as below 100° C. or down to about room temperature.

The solution treatment and quench may be applied to blanks, sheets, or other forms of raw materials, which may then be set aside or rolled into coils for later processing. Alternatively, the solution treatment and quench may be incorporated into a hot stamping process wherein the solution treatment is performed on a blank and the quench is performed during a stamping process using a cooled die. The resulting stamped part is therefore solution treated and quenched and ready for subsequent processing (e.g., age hardening). This process is described in U.S. Pat. No. 8,496,764, the disclosure of which is hereby incorporated in its entirety by reference herein.

In order to achieve a YS of at least 400 MPa or more, a solution treated and quenched 7xxx series aluminum alloy must be age hardened (or precipitation hardened). Age hardening includes heating and maintaining the alloy at an elevated temperature at which there are two or more phases at equilibrium. The supersaturated alloy forms fine, dispersed precipitates throughout as a result of diffusion within the alloy. The precipitates begin as clusters of atoms, which then grow to form GP zones, which are on the order of a few nanometers in size and are generally crystallographically coherent with the surrounding metal matrix. As the GP zones grow in size, they become precipitates, which strengthen the alloy by impeding dislocation movement. Since the precipitates are very finely dispersed within the alloy, dislocations cannot move easily and must either go around or cut through the precipitates in order to propagate.

Five basic temper designations may be used for aluminum alloys which are; F-as fabricated, O-annealed, H-strain hardened, T-thermally treated, and W-as quenched (between solution heat treatment and artificial or natural aging). The as-received raw material for the disclosed solutionizing and age hardening processes may initially have any of the above temper designations. The temper designation may be followed by a single or double digit number for further delineation. An aluminum alloy with a T6 temper designation may be an alloy which has been solution heat treated and artificially aged, but not cold worked after the solution heat treatment (or such that cold working would not be recognizable in the material properties). T6 may represent the point of peak age yield strength along the yield strength vs. time and temperature profile for the material. A T7x temper may designate that a solution heat treatment has occurred, and that the material was artificially aged beyond the peak age yield strength (over-aged) along the yield strength vs. time and temperature profile. A T7x temper material may have a lower yield strength than a T6 temper material, but the T7x temper generally provides increased corrosion performance compared to the T6 temper. In one embodiment, a 7xxx series aluminum alloy part with a T6 temper is formed with a YS of at least 500 MPa. In another embodiment, a T7x temper is formed, such as a T73 or T76 temper. A T7x temper material may have a YS of at least 450 MPa.

Due to their high yield strengths and relatively low weight, 7xxx series aluminum alloys have been used in the aerospace industry. The aerospace industry uses the 7xxx series alloys in parts with multiple different shapes, such as plates, extrusions, and sheets. The industry has established standard age hardening heat treatments for 7xxx alloys that includes holding the alloy at a temperature of about 110-130° C. for over 20 hours. For example, the standard age hardening heat treatment for 7075 aluminum is 115-126° C. for 24 hours to achieve a T6 temper. For the relatively low volume of parts and the less restrictive budget of the aerospace industry, this long treatment time is acceptable. However, to minimize costs and accommodate the high volumes of the automotive industry, the 24 hour aging process is both too long and too capitally intensive to be acceptable. For example, if the hot stamping process described in U.S. Pat. No. 8,496,764 were used in conjunction with the 24 hour age hardening treatment, the stamping to finished product cycle time would not support high volume throughputs. To make the use of 7xxx series aluminum alloys more commercially viable in the automotive industry, the age hardening heat treatment time must be reduced, while still maintaining high yield strength (e.g., a T6 temper, or close thereto).

Referring to FIG. 1, a system 10 for heat treating an aluminum alloy component is shown. The aluminum alloy component is shown in the form of a blank 12, however, the component may be in the form of a plate, extrusion, sheet, strips, bars, or the like. In addition, the blank 12 may be a formed part or a rack of parts. The component may be a W-temper 7xxx series aluminum alloy, for example, 7075. The system 10 may include a first heating apparatus 14. The heating apparatus 14 may be provided to heat the blank 12. The heating apparatus 14 may be an industrial furnace or oven capable of producing internal temperatures high enough to heat blanks 12 placed in the heating apparatus 14 to a predetermined temperature, such an age hardening temperature. The heating apparatus 14 may be a convection oven. A second heating apparatus 16 may be provided, that may be similar to the first heating apparatus 14. The first and second heating apparatuses 14, 16 may be connected by a conveyor 18. In at least one embodiment, the first heating apparatus 14 and the second heating apparatus 16 are maintained at different temperatures.

A blank, part, or rack of parts 12 (referred to hereinafter collectively as "blank 12") may be carried by the conveyor 18 in to the first heating apparatus 14, which may be open or have a door that opens and closes to allow the blank 12 to enter. The conveyor 18 may be configured to move at a predetermined speed such that the blank 12 is in the first heating apparatus 14 for a certain length of time. The blank 12 may then exit the first heating apparatus (e.g., through another door) and may then enter the second heating apparatus 16, which may be maintained at a different temperature from the first heating apparatus 14.

As shown in FIG. 1, the first and second heating apparatuses 14, 16 are directly adjacent such that the blank 12 is not exposed to the ambient conditions of the room. However, it may be possible for there to be a separation between the heating apparatuses. The conveyor 18 may be configured to move at a predetermined speed such that the blank 12 is in the second heating apparatus 16 for a certain length of time. The conveyor 18 may have multiple sections 18A and 18B that move at different speeds in the first heating apparatus 14 and in the second heating apparatus 16. Alternatively, the conveyor 18 may move at a single speed and the length of the heating apparatuses 14, 16 may be configured such that the blank 12 is inside them for the desired times. When multiple blanks are on the conveyor 18, the spacing of the blanks 12 may also be adjusted such that the desired exposure time is achieved. Any combination of conveyor speed, heating apparatus length, blank spacing, or other suitable methods may therefore be used to control exposure time in each heating apparatus 14, 16. Additional heating apparatuses may also be included, if more than two heat treatment temperatures are to be used.

In another embodiment, the system 10 may include a single heating apparatus 14. The heating apparatus 14 may receive a blank 12 that is on a conveyor, or the blank 12 may be stationary. The temperature within the heating apparatus 14 may be adjusted during the course of a heat treatment of a blank 12. This may eliminate the need a second heating apparatus 16 or other additional heating apparatuses. It may also eliminate the need for a large heating apparatus that accommodates a conveyor 18. However, a conveyor 18 may still be utilized in a single heating apparatus 14 system. The heating apparatus 14 may be programmed to change the temperature therein one or more times during a single heat treatment such that the blank 12 is treated at two or more different temperatures throughout the treatment. Since there is only one heating apparatus 14 in this embodiment, the change in temperature will generally include a ramping up or down of the temperature in between temperature settings. However, a fast ramping of the temperature may effectively result in a two-temperature heat treatment.

Figure 2:
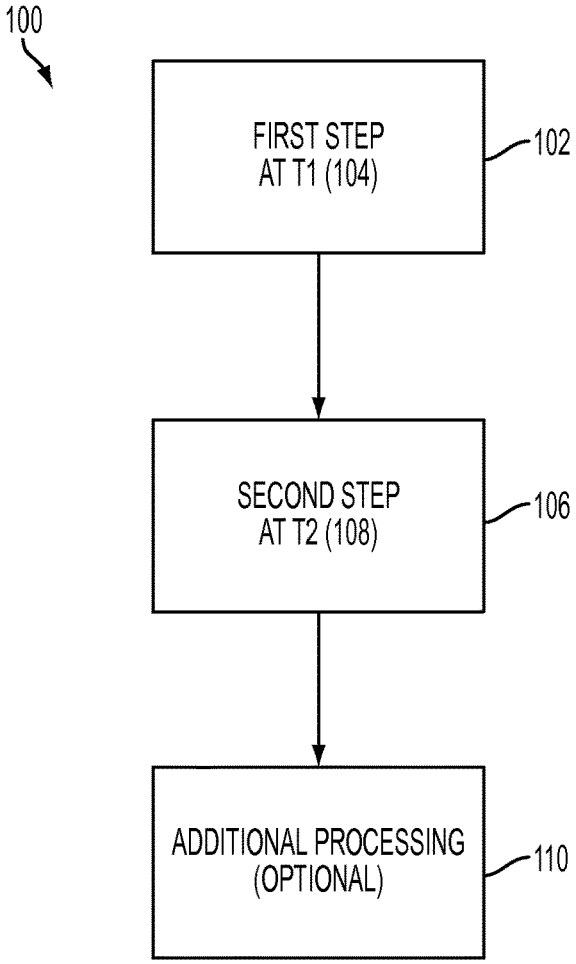
FIG. 2 is a flow diagram for a two-step age hardening process.

The system 10 may be used to perform a two-step age hardening heat treatment 100 on an aluminum alloy, as shown in FIG. 2. The aluminum alloy is a 7xxx series alloy, for example, a W-temper 7xxx series alloy. As described above, the aluminum alloy component may be in any form, such as plate, extrusion, sheet, strips, bars, or others. The two-step age hardening heat treatment 100 may include a first step 102 having a first temperature 104 and a second step 106 having a second, different temperature 108. The first temperature 104 and the second temperature 108 may be substantially constant throughout steps 102 and 106, respectively, or may vary within a defined temperature range. In at least one embodiment, the second temperature 108 is higher than the first temperature 104. However, the second temperature 108 may be lower than the first temperature 104 in some embodiments. The first step 102 and the second step 106 may have the same duration or different durations. In at least one embodiment, the second step 106 has a longer duration than the first step 102. However, the second step 106 may have a shorter duration than the first step 102 in some embodiments. After the second step 108 of the age hardening treatment, the blank 12 may be completed or it may be subject to additional processing steps 110.

In at least one embodiment, the first temperature 104 is from 100 to 150° C. However, the first temperature 104 may also be any narrower subset of 100 to 150° C., for example, the first temperature 104 may be from 105 to 135° C. or from 110 to 130° C. Other examples may include any temperature or subset of the temperatures listed in the first column of Table 1, below, such as 105 to 145° C. or 105 to 125° C.

In at least one embodiment, the second temperature 108 is from 150 to 185° C. However, the second temperature 108 may also be any narrower subset of 150 to 185° C., for example, the second temperature 108 may be from 155 to 185° C. or from 160 to 180° C. Other examples may include any temperature or subset of the temperatures listed in the first row of Table 1, below, such as 160 to 175° C. or 165 to 175° C.

In at least one embodiment, the first step 102 has a duration of 0.2 to 3 hours. However, the first step 102 may also have a duration that is any narrower subset of 0.2 to 3 hours, for example, 0.5 to 2 hours or 1 to 2 hours. Other examples may include any time or subset of the times listed in the second column of Table 1, below.

In at least one embodiment, the second step 106 has a duration of 0.5 to 5 hours. However, the second step 106 may also have a duration that is any narrower subset of 0.5 to 5 hours, for example, 1 to 4 hours or 2 to 3 hours. Other examples may include any time or subset of the times listed in the second row of Table 1, below, such as 1 to 3 hours or 2 to 4 hours.

In at least one embodiment, a total duration of the first and second steps 102, 106 is at most 8 hours. The total duration may have a lower total duration than 8 hours, for example, it may be at most 7, 6, 5, or less hours. In another embodiment, a total duration of the first and second steps 102, 106 is from 1 to 8 hours. However, the total duration may also be any narrower subset of 1 to 8 hours, for example, 1.5 to 7 hours or 2 to 6 hours. Other examples may include any subset of sums of the times listed in the second column and second row of Table 1, below, such as 2.5 to 5 hours or 3 to 4.5 hours.

The two-step age hardening heat treatment 100 may reduce the total age hardening time compared to the standard heat treatments of about 24 hours by at least 67%. In at least one embodiment, the two-step age hardening heat treatment 100 results in a 7xxx alloy having a yield strength of at least 490 MPa. The two-step age hardening heat treatment 100 may result in a 7xxx alloy having a yield strength of at least 495 MPa or at least 500 MPa (e.g., a T6-like temper). The reduction in age hardening time may allow alloys such as the 7xxx series to be used in automotive applications due to substantially reduced cycle times. Reduced cycle times may allow parts formed of 7xxx series alloys to be produced in high volumes at acceptable costs, which was previously not possible with 24 hour age hardening heat treatments.

The exact mechanism and theory of operation behind age hardening is not completely understood or uniformly agreed upon. However, without being held to any particular theory, it is believed that the two-step age hardening process works by forming finely dispersed clusters in the first step and growing the clusters into precipitates in the second step. In the first, lower temperature step, clusters are established which are very finely dispersed due to the relatively slow diffusion rate at the lower temperature. Once the clusters are established in the first step, the elevated temperature in the second step causes the clusters to grow into precipitates in a shorter amount of time, due to the faster diffusion rate at the higher temperature. The result of the two-step process is an age hardened alloy (e.g., a 7xxx series aluminum, such as 7075) having approximately the same YS and other properties as the same alloy age hardened at a single temperature for over three times as long.

EXAMPLES

Square coupons of 7075 aluminum rolled sheet 2 mm thick and 4 inches wide were prepared by solutionizing at 480° C. for 30 minutes and quenching for 30 seconds to form a supersaturated solid solution. Each coupon was then heat treated using a two-step age hardening process. Coupons were treated at 105° C., 115° C., 125° C., 135° C., and 145° C. for the first step and at 155° C., 160° C., 165° C., 170° C., 175° C., and 180° C. for the second step. The first step exposure times were 0.5, 1, and 2 hours and the second step exposure times were 1, 2, 3, and 4 hours. Accordingly a total of 360 different two-step age hardening processes were tested. Yield strength testing was done by cutting each coupon into strips and averaging the yield strength of three strips to attain the yield strength for each coupon. Table 1, below, shows the yield strength data with the first step parameters on the vertical axis and the second step parameters on the horizontal axis.

TABLE 1

Yield strength data for two-step age hardening process at various temperatures and exposure times.

| YS | | temp | | | | | | | |
|---|---|---|---|---|---|---|---|---|---|
| | | 155 | | | | 160 | | | |
| | | time | | | | | | | |
| temp | | 1 | 2 | 3 | 4 | 1 | 2 | 3 | 4 |
| 105 | 0.5 | 461 | 490 | 499 | 509 | 479 | 498 | 498 | 506 |
| 105 | 1 | 469 | 494 | 506 | 508 | 474 | 495 | 503 | 504 |
| 105 | 2 | 473 | 496 | 506 | 511 | 477 | 499 | 511 | 508 |
| 115 | 0.5 | 473 | 499 | 504 | 501 | 482 | 500 | 504 | 500 |
| 115 | 1 | 474 | 498 | 503 | 506 | 483 | 502 | 503 | 506 |
| 115 | 2 | 481 | 501 | 505 | 508 | 487 | 504 | 509 | 511 |
| 125 | 0.5 | 471 | 490 | 496 | 494 | 480 | 496 | 497 | 494 |
| 125 | 1 | 475 | 495 | 500 | 499 | 482 | 499 | 498 | 496 |
| 125 | 2 | 480 | 498 | 501 | 500 | 488 | 499 | 507 | 503 |
| 135 | 0.5 | 464 | 484 | 488 | 488 | 474 | 490 | 489 | 479 |
| 135 | 1 | 471 | 484 | 485 | 481 | 472 | 489 | 489 | 481 |
| 135 | 2 | 472 | 486 | 486 | 489 | 478 | 489 | 487 | 477 |
| 145 | 0.5 | 455 | 472 | 468 | 468 | 459 | 476 | 470 | 461 |
| 145 | 1 | 457 | 475 | 476 | 467 | 467 | 473 | 475 | 459 |
| 145 | 2 | 470 | 479 | 470 | 464 | 465 | 476 | 475 | 455 |

| YS | | temp | | | | | | | |
|---|---|---|---|---|---|---|---|---|---|
| | | 165 | | | | 170 | | | |
| | | time | | | | | | | |
| temp | | 1 | 2 | 3 | 4 | 1 | 2 | 3 | 4 |
| 105 | 0.5 | 485 | 499 | 505 | 503 | 484 | 500 | 502 | 504 |
| 105 | 1 | 482 | 503 | 506 | 504 | 490 | 505 | 504 | 505 |
| 105 | 2 | 486 | 502 | 507 | 510 | 501 | 510 | 510 | 510 |
| 115 | 0.5 | 482 | 494 | 503 | 502 | 493 | 504 | 507 | 504 |
| 115 | 1 | 482 | 498 | 506 | 504 | 493 | 505 | 511 | 508 |
| 115 | 2 | 490 | 505 | 510 | 506 | 500 | 511 | 508 | 507 |
| 125 | 0.5 | 479 | 491 | 490 | 490 | 486 | 495 | 497 | 495 |
| 125 | 1 | 483 | 494 | 501 | 493 | 493 | 503 | 500 | 496 |
| 125 | 2 | 491 | 497 | 505 | 497 | 496 | 507 | 506 | 502 |
| 135 | 0.5 | 473 | 485 | 487 | 479 | 480 | 488 | 490 | 480 |
| 135 | 1 | 474 | 486 | 485 | 472 | 480 | 490 | 488 | 474 |
| 135 | 2 | 477 | 491 | 485 | 475 | 486 | 495 | 493 | 485 |
| 145 | 0.5 | 458 | 466 | 467 | 449 | 464 | 475 | 470 | 454 |
| 145 | 1 | 461 | 474 | 473 | 457 | 469 | 476 | 475 | 460 |
| 145 | 2 | 466 | 472 | 468 | 449 | 473 | 475 | 475 | 458 |

TABLE 1-continued

Yield strength data for two-step age hardening process at various temperatures and exposure times.

| YS | | temp | | | | | | | |
|---|---|---|---|---|---|---|---|---|---|
| | | 175 | | | | 180 | | | |
| | | time | | | | | | | |
| temp | | 1 | 2 | 3 | 4 | 1 | 2 | 3 | 4 |
| 105 | 0.5 | 489 | 505 | 505 | 502 | 496 | 505 | 498 | 490 |
| 105 | 1 | 490 | 501 | 504 | 499 | 495 | 502 | 495 | 489 |
| 105 | 2 | 501 | 508 | 507 | 503 | 501 | 508 | 499 | 493 |
| 115 | 0.5 | 500 | 502 | 503 | 502 | 501 | 502 | 501 | 497 |
| 115 | 1 | 500 | 508 | 507 | 502 | 497 | 509 | 509 | 506 |
| 115 | 2 | 499 | 505 | 501 | 492 | 501 | 507 | 503 | 495 |
| 125 | 0.5 | 490 | 497 | 502 | 492 | 496 | 498 | 494 | 486 |
| 125 | 1 | 496 | 502 | 503 | 493 | 496 | 500 | 496 | 490 |
| 125 | 2 | 495 | 505 | 507 | 495 | 496 | 504 | 500 | 490 |
| 135 | 0.5 | 478 | 488 | 485 | 475 | 482 | 485 | 481 | 469 |
| 135 | 1 | 485 | 491 | 486 | 476 | 483 | 491 | 484 | 472 |
| 135 | 2 | 483 | 486 | 483 | 475 | 486 | 490 | 490 | 473 |
| 145 | 0.5 | 466 | 477 | 466 | 458 | 468 | 473 | 467 | 449 |
| 145 | 1 | 467 | 474 | 469 | 455 | 468 | 473 | 466 | 448 |
| 145 | 2 | 463 | 471 | 469 | 452 | 477 | 477 | 469 | 451 |

Figure 3:
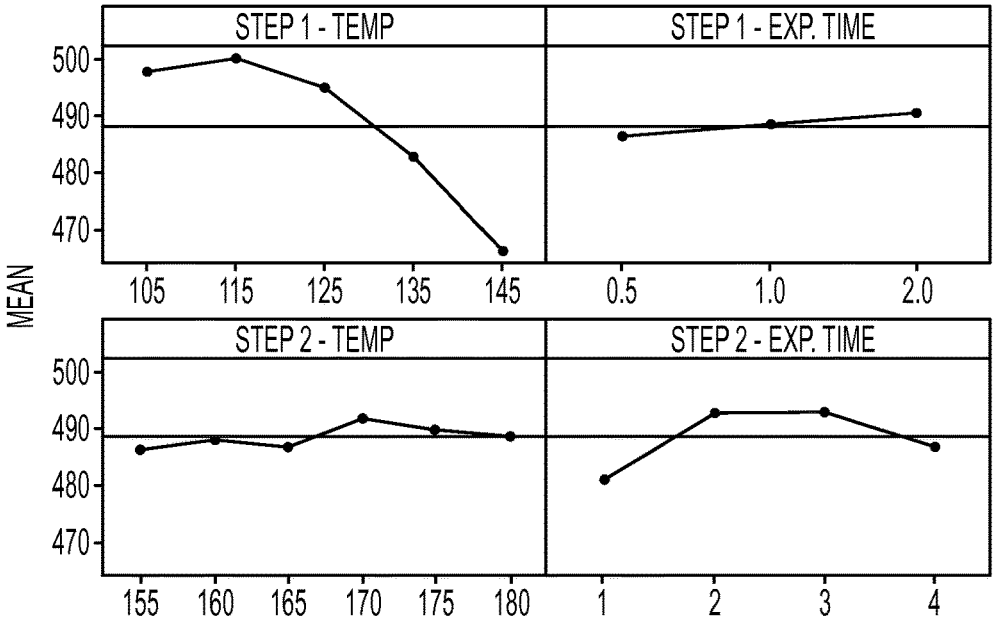
FIG. 3 is a main effects plot of yield strength (MPa) vs. temperature (° C.) and time (hours) for a two-step age hardening process.

As can be seen by the data in Table 1, the two-step age hardening process can achieve yield strengths of at least 500 MPa in under 2 hours (e.g., 0.5 hours at 115° C. and 2 hours at 175° C.) and at numerous different time and temperature combinations in under 6 hours. FIG. 3 shows a main effects plot for average yield strength (y-axis, MPa) vs. temperature and time (x-axis, ° C. and hours, respectively) for steps one and two. The plots show that for step one, a temperature between 105° C. and 125° C. and an exposure time of about two hours results in the highest average yield strength. For step two, the plots show that a temperature between 160° C. and 180° C. and an exposure time of about two to three hours results in the highest average yield strength. According to the plots, the peak strength occurs with a first step of approximately 115° C. for about two hours and a second step of approximately 170° C. for about two hours.

By interpolating the data in Table 1, peak yield strength may be achieved using a two-step age hardening treatment including a first step at approximately 110° C. for about two hours and a second step at approximately 165° C. for about three hours. This two-step treatment would therefore have a total artificial aging time of 5 hours, a reduction of 19 hours (79.2%) compared to the standard 24 hour aging. Since artificial aging is the most time consuming step in the solution treating/quenching/aging process, the overall cycle time may be reduced by almost the same percentage as the reduction in aging time. However, peak yield strength may not always be the most important consideration. Other factors, such as cycle time, oven/furnace temperature, cost, or other parameters/constraints may require a two-step process that has slightly less than peak yield strength. In addition, production robustness may be an important consideration and may lead to the use of a two-step process that is not the fastest, cheapest, and/or does not have the highest yield strength, but still has a T6 temper. For example, the first step may be the most robust at temperatures from 105° C. to 120° C. for times from one to two hours and the second step may be the most robust at temperatures of 155° C. to 175° C. for two to four hours.

Figure 4:
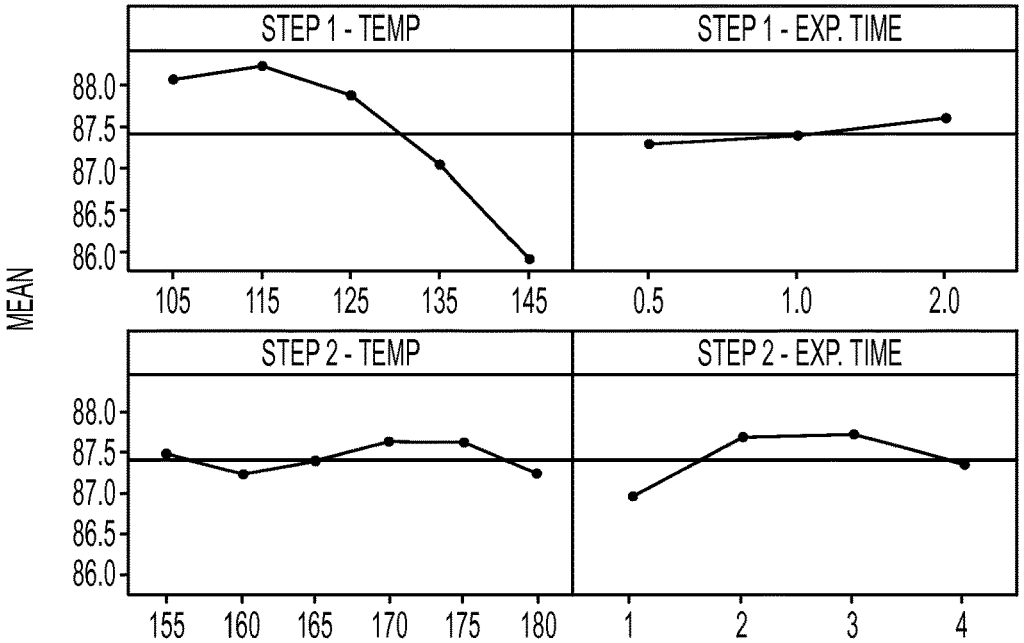
FIG. 4 is a main effects plot of hardness (HRB) vs. temperature (° C.) and time (hours) for a two-step age hardening process.
Figure 5:
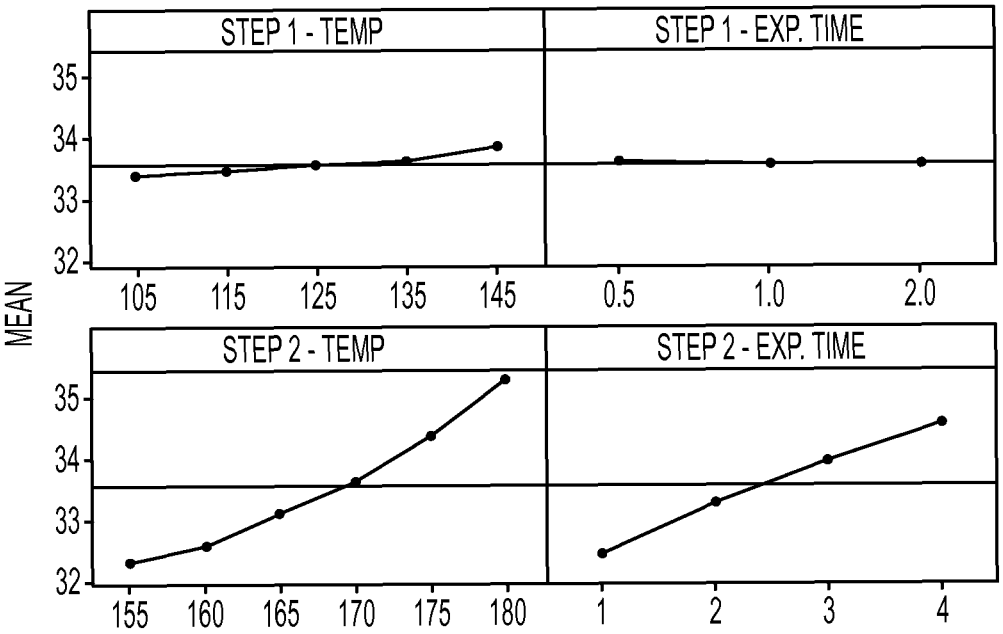
FIG. 5 is a main effects plot of conductivity (% IACS) vs. temperature (° C.) and time (hours) for a two-step age hardening process.

In addition to yield strength, hardness and conductivity are material properties that are of interest for 7xxx series alloys. An age hardened 7xxx series aluminum may have a Rockwell-B hardness of at least 84 HRB and conductivity of 30.5-36% IACS. FIGS. 3, 4, and 5 show main effects plots from the yield strength, hardness and conductivity, respectively, based on the data collected from the samples used for Table 1. FIG. 4 shows a main effects plot for hardness (y-axis, HRB) vs. temperature and time (x-axis, ° C. and hours, respectively). FIG. 5 shows a main effects plot for conductivity (y-axis, % IACS) vs. temperature and time (x-axis, ° C. and hours, respectively) As seen in FIGS. 4 and 5, all of the average values for hardness and conductivity fall within the required limits for a T6 temper designation. Therefore, yield strength is the parameter that should be weighted the most when identifying acceptable or optimal heat treatment processes.

While exemplary embodiments are described above, it is not intended that these embodiments describe all possible forms of the disclosure. The words used in the specification are words of description rather than limitation. Changes may be made to the illustrated embodiments without departing from the spirit and scope of the disclosure as claimed. The features of the illustrated embodiments may be combined to form further embodiments of the disclosed concepts.

What is claimed is:

1. A 7075 aluminum alloy two-step age hardening method comprising:

heat treating a 7075 aluminum alloy at a first temperature in a range of 125° C. to 150° C. for a first exposure time T1; and heat treating the alloy at a second temperature higher than the first temperature for a second exposure time T2 to form a 7075 aluminum alloy having a yield strength of at least 490 MPa;

wherein the second exposure time T2 is selected such that T1+T2≤5.

2. The method of claim 1, wherein the second temperature is from 155° C. to 185° C.

3. The method of claim 1, wherein the second temperature is from 170° C. to 180° C.

4. The method of claim 1, wherein the first exposure time is from 0.2 to 2 hours and the second exposure time is from 0.5 to 3 hours.

5. The method of claim 1, wherein the aluminum alloy is an alloy sheet having a thickness of 2 mm.

6. The method of claim 1, wherein the alloy is formed as a blank, part, or rack of parts.

7. The method of claim 1, wherein the heat treating at the first temperature is performed in a first heating apparatus and the heat treating at the second temperature is performed in a second heating apparatus.

8. The method of claim 7, wherein the alloy is transported from the first heating apparatus to the second heating apparatus by a conveyor.

9. The method of claim 1, wherein the heat treating at the first temperature and the heat treating at the second temperature are performed in a same heating apparatus.

10. A two-step method of age hardening a 7075 aluminum alloy sheet comprising:

a first heat treatment at 125° C. to 145° C. for 0.2 to less than 2 hours; and a second heat treatment at 175° C. to 185° C. for 0.5 to less than 2 hours to form a 7075 aluminum alloy sheet, for automotive applications, having a yield strength of at least 490 MPa without additional heat treatment.

11. The method of claim 10, wherein the second heat treatment forms an alloy sheet having a yield strength of at least 500 MPa.

12. The method of claim 10, wherein the sheet is 2 mm thick.

13. The method of claim 1, wherein the 7075 aluminum alloy comprises 5.1 to 6.1 wt. % Zn, 2.1 to 2.9 wt. % Mg, 1.2 to 2.0 wt. % Cu, and less than 0.5 wt. % Si, Fe, Mn, Ti, Cr, and other metals, the balance being Al, based on the weight percent of the alloy.

14. The method of claim 1, wherein the second heat treating step is the final heat treating step.

15. A two-step age hardening method comprising:

heat treating a 7075 aluminum alloy at a first temperature in a range of 125° C. to 150° C. for a first exposure time T1 in the range of 0.2 to 2 hours; and heat treating the alloy at a second temperature higher than the first temperature for a second exposure time T2 in the range of 0.2 to 4 hours, wherein the second exposure time T2 is selected such that T1+T2≤5.

* * * * *